United States Patent [19]

van den Haak

[11] 4,154,186

[45] May 15, 1979

[54] BOAT ANCHOR

[76] Inventor: Rob van den Haak, 114 Allegro, Krimpen a/d Ijssel, Netherlands

[21] Appl. No.: 915,794

[22] Filed: Jun. 15, 1978

Related U.S. Application Data

[63] Continuation of Ser. No. 774,446, Mar. 4, 1977, abandoned.

[30] Foreign Application Priority Data

Mar. 10, 1976 [NL] Netherlands ..... 7602497

[51] Int. Cl.[2] ..... B63B 21/24; B63B 21/27; B63B 21/29

[52] U.S. Cl. ..... 114/304

[58] Field of Search ..... 114/297-310

[56] References Cited

U.S. PATENT DOCUMENTS

| | | | |
|---|---|---|---|
| 2,053,838 | 9/1936 | Lundin | 114/307 |
| 2,377,054 | 5/1945 | Thayer | 114/297 |
| 2,816,522 | 12/1957 | Root | 114/299 |
| 3,269,348 | 8/1966 | Churchward | 114/299 |

FOREIGN PATENT DOCUMENTS

| | | | |
|---|---|---|---|
| 135733 | 5/1952 | Sweden | 114/304 |
| 14646 of | 1888 | United Kingdom | 114/304 |
| 8068 of | 1904 | United Kingdom | 114/304 |
| 135782 | 12/1919 | United Kingdom | 114/208 |
| 201799 | 8/1923 | United Kingdom | 114/304 |
| 150024 | 12/1972 | U.S.S.R. | 114/304 |

*Primary Examiner*—Trygve M. Blix
*Assistant Examiner*—D. W. Keen
*Attorney, Agent, or Firm*—Marn & Jangarathis

[57] ABSTRACT

An anchor having a two-handed fluke, the two hands thereof being separated by a slot in which the anchor shank is mounted for slewing to each side of the fluke on a pivot which substantially coincides with the geometric center of the fluke surface area and is journaled in a pivot box formed by side plates on the inner edges of the fluke hands and head plates connecting the side plates and delimiting the slewing angle of the shank, and having rear stabilizers on the outer edges of the fluke hands, and the fluke hands each having a pair of outwardly curved finger tips on which flange plates with upstanding tips are arranged forming front stabilizers.

5 Claims, 11 Drawing Figures

BOAT ANCHOR

This is a continuation of application Ser. No. 774,446, filed 3/4/77, now abandoned.

BACKGROUND OF THE INVENTION

This invention relates to an additional improvement of an anchor as described in the Netherlands' patent specification No. 151 034 and in the corresponding U.S. Pat. No. 3,902,466. The main features of this type of anchor, which is called STEVIN anchor, are that it has a two-handed fluke with the anchor shank pivotally mounted in a slot between the two fluke hands on a hinge in a hinge box formed at about the geometric centre of the fluke surface area by side plates on the inner edges of the fluke hands and head plates connecting the side plates and delimiting the piovoting angle of the shank, and the fluke hands converging from a substantial depth at their inner edges towards each other to form sharp outer edges, and that it has rear stabilizers on the outer edges of the fluke hands.

The fluke hands of the anchor type in the aforesaid patent specifications each terminate forwardly in a flat tip. It appeared in practice that in hard ground the thus far described anchor keeps on sliding along the ground on the shank and will not penetrate further.

SUMMARY OF THE INVENTION

The present invention has as its object to overcome the aforesaid disadvantage of the prior anchor type and is characterized in that each fluke hand has a pair of outwardly curved finger tips on which flange plates with upstanding tips are arranged forming front stabilizers. This novel feature improves the cutting penetration action in hard ground due to the fact that the stability of the anchor during its penetration is enhanced.

An additional aspect is that the hinge box and the rear stabilizers are diverging rearwardly, considered in plan view, i.e., that the openings therebetween are widened rearwardly so that the penetrating soil will not cause obstructions which would impede the action of the stabilizers.

Further provided is a pre-cutter to facilitate the penetration of the shank.

The new anchor is further characterized by an opening for an anchor shackle in the rear end of the fluke, and the anchor shackle and the hinge pin are integrally cast on the shank.

The invention is described more in detail in the following specification with reference to the drawings, in which examples of the invention are shown.

DESCRIPTION OF THE PREFERRED EMBODIMENTS

Figures 1, 3, 4, 5, 6, 7, 8:
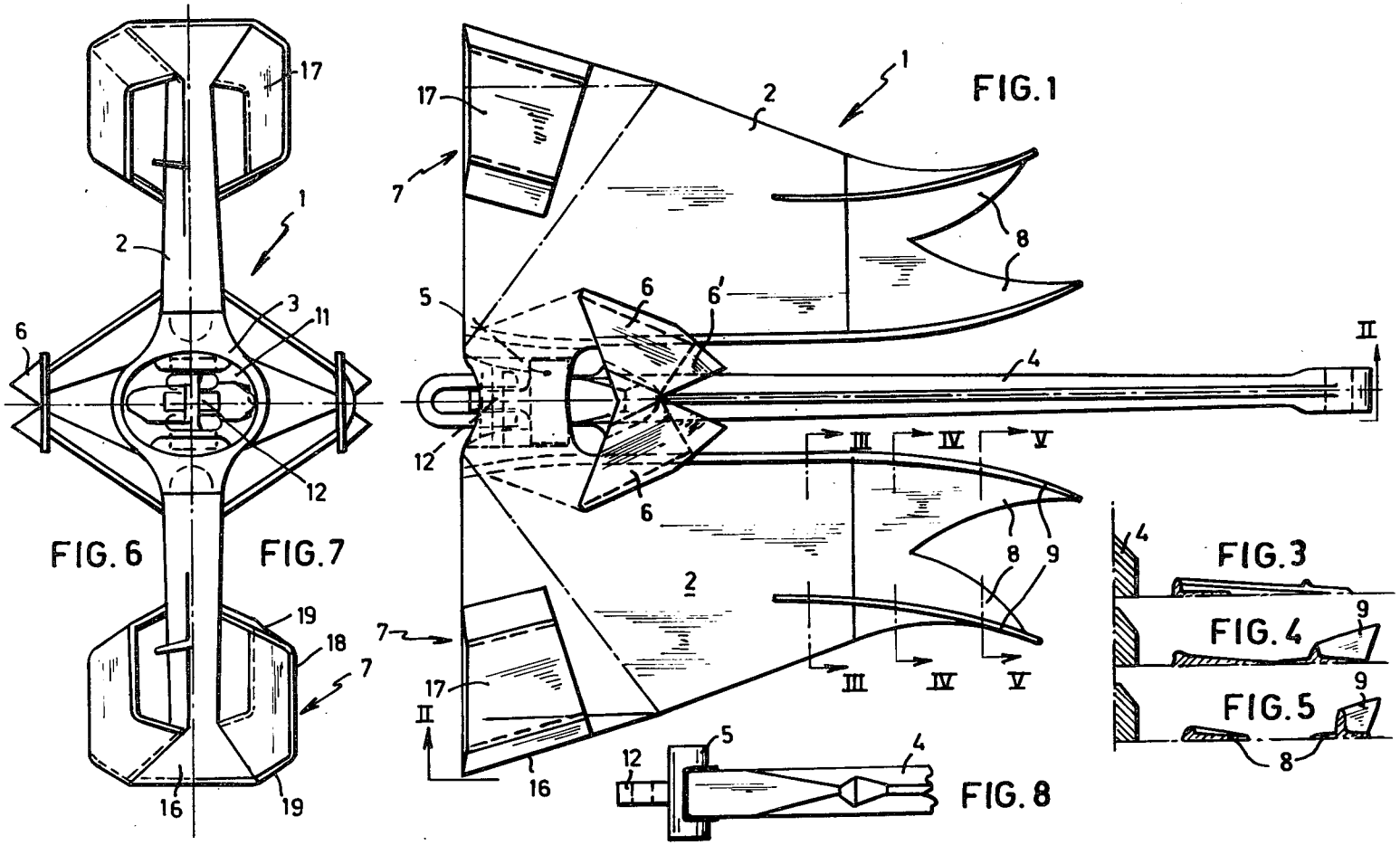
FIG. 1 is a plan view of the new anchor.
FIGS. 3 through 5 are respective sectional views according to the lines III—III, IV—IV and V—V in FIG. 1.
FIG. 6 is a semi-front view of the anchor.
FIG. 7 is a semi-rear view of the anchor.
FIG. 8 is a top view of a part of the shank with the hinge pin and the new anchor shackle.

The anchor 1 as shown in the figures is provided with a pair of flukes or fluke hands 2,2 which are rearwardly integrally joined by a hinge box 3.

The shank is pivotally connected to the flukes 2 by a pivot pin 5 which is journaled in the hinge box 3. In front of the box 3 are a pair of fluke angle delimiters 6 above and below the shank 4, which are divergingly rearwardly directed, with a thus rearwardly widening opening therebetween in order to prevent clod formation when penetrating into the ground. Also the rear stabilizers 7,7 are arranged so that they diverge rearwardly to prevent clod formation to occur due to which their stabilizing action would be impeded.

Particularly in FIG. 1 the new front stabilizers are illustrated. Each fluke 2 has a pair of outwardly curved tips 8 for penetration in hard ground. For the stabilization during penetration serves a vertical fluke 9 on the outer and eventually on the inner fluke tips 8, which is inwardly directed while forming diverging peaks 10.

In the rear of the hinge box 3 which connects the two flukes 2, there is an opening 11 for an anchor shackle 12 which can be used for tandem arranged anchors. The anchor shackle 12 and the hinge pin 5 are integrally cast on the shank 4.

Figure 2:
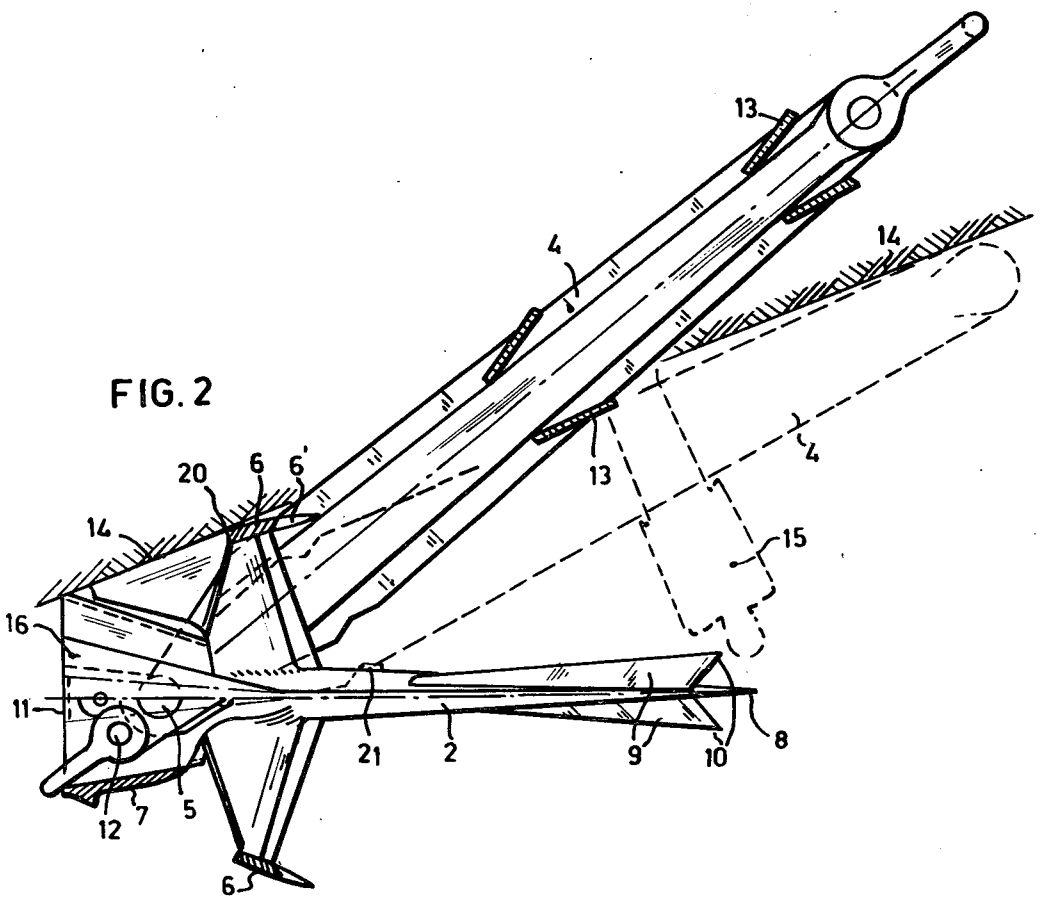
FIG. 2 is a view in elevation, and partly in section, of the anchor which is lying on the water bed as illustrated, but when considering the view turned upside down the anchor is seen in this figure lying with the shank shown in dotted lines on a deck.

As is particularly illustrated in FIG. 2 the anchor 1 is provided with a pre-cutter 13 so that the shank 4 can easily penetrate. In this figure the anchor is shown in its position on the water bed, but when the drawing is turned upside down, the anchor is seen with the shank 4 in dotted lines lying on a deck 14, and in dotted lines at 15 also the height of a man is indicated on a scale corresponding with a 15 tons anchor. The anchor 1 has a negative penetration position when it lies on the deck 14, to prevent it from damaging the deck.

Generally stated the main factors for the holding power of an anchor are penetration, strength and stability.

Penetration is achieved by sharp fluke tips and an anchor which is streamlined as much as possible.

The latter is achieved by arranging the fluke angle delimiters 6 so that a maximum fluke angle is obtained. The fluke angle delimiters consist as illustrated in FIG. 1 of rearwardly converging plates which leave a rearwardly widened opening therebetween considered in a cross-sectional plane parallel to the anchor ground.

The anchor is designed so that eventually penetrating soil at that location will not cause obstructions in the hinge box 3 which serves to rigidly connect the two flukes 2. The shank 4 can be passed through the box from the rear and the hinge pin 5 can be secured by means of two little locks.

The anchors which are thus far used offshore have the disadvantage that the attachment of a tandem arranged anchor renders the anchor unstable. Generally the pennant-wires are fastened to the flukes. In the present anchor the anchor shackle 12 is secured to the pivoted shank 4. Pulling is now in line with the main chain or wire and the anchor remains stable. Moreover this is production saving as it is now not necessary to provide a separately welded-on shackle. The pivot pin 4 is also cast integrally on the shank 4.

To prevent clod formation, i.e., obstruction of the passing sand, and depth of the fluke 2 within the fluke angle delimiters 7 is reduced. in other anchors this would always lead to clod formation and the anchor would break out earlier. In the present pivotal anchor this is prevented.

As is already mentioned in the foregoing it appeared in practice that generally in hard ground pivotal anchors keep on sliding along the ground on the shank and will not penetrate further. The portion of the fluke which is in the hard ground should provide that on the one hand the shank is still somewhat forced threin and on the other hand that the quantity of shifted soil is as large as possible. A square fluke tip would counteract penetration, a round and/or sharp tip would limit again the width of the fluke at the rear side, and accordingly, the surface area. By providing two pairs of fluke tips 8 a better cutting penetration action in hard ground is achieved. Moreover this enhances the stability during penetration. The outwardly directed fluke tips facilitate breaking-in when the anchor would unexpectedly be pulled along the ground on the fluke side.

For breaking-in and stabilisation a vertical plate is to be arranged at the front of a fluke tip, which is outwardly directed with the front side 10. The object thereof is that when the anchor slides along the side, the vertical plate at the front side penetrates into the ground, whereupon the anchor will pull itself again in the normal manner into the ground.

On the other hand these plates have the property that when the anchor after penetration is askew the fluke tip which is most deeply penetrated is automatically pulled out by the plate 9 by greater pressure and the anchor thus stabilizes.

Stabilisation stocks, prisms or plates are often used in anchors. Stocks have the disadvantage that in hard ground the stocks would counteract the penetration. Frameworks as in the Eel-anchor have the disadvantage that they extend parallel to the flukes and thus have a bad stabilizing action. In that case they only serve to effect the correct penetration position.

The combination of the wings of the Stevin-anchor and the frame of the Eel-anchor as used in the Flipper Delta-anchor, has the disadvantage that when breaking out along the whole width of that framework a wall of sand is created, as due to the diverging plates the sand in the framework is compressed.

Prisms have the disadvantage that when penetrating into hard ground too much resistance is offered and the anchor will break out earlier than is necessary.

In order to obtain a good penetration the two fluke plates rearwardly at the sides are outwardly curved and at the outer sides they are provided with a vertical converging plate 16 which is favourable for the stabilizing action of the anchor.

An enhanced stabilizing action is achieved by a converging bent plate 17. In this case to be arranged on the top and bottom of the two flukes along about one third of the fluke width, so not along the whole width as in the Flipper anchor and not parallel as in the Eel-anchor.

Besides the simple manufacture of this stabilizer it has the advantage that the top 18 serves for the correct penetration position and the sides for a correct stabilisation. The anchor will nevertheless keep a correct penetrating action because this stabilizer, due to the converging shape, will not retain the ground, but will pass it easily.

The fluke angle delimiters 6 which are equipped with claws 6' for penetration in hard ground, and the stabilizers are formed so that the anchor will be directly upwardly with the fluke tips and thus will not damage the deck of the anchor handling vessels with the sharp tips 6' and 10.

Accordingly, when the anchor is hauled in on the pennant-wire the anchor will automatically rest on three points 20. If the anchor is pulled forward again to enter the water, a releasable wire or rod 21 can temporarily be placed between fluke and shank as is indicated in the drawing.

On the bottom of the sea the fluke will automatically be canted downwardly with the tips due to the high pressure on the fluke delimiters. In soft ground the top and bottom side of the stabilizers will take over the function of adjusting the penetration angle.

As is already mentioned in the foregoing the shank has in hard ground the tendency to slide along the bottom. By using a precutter as indicated at 13 a groove is first cut in the hard ground, which will facilitate the penetration of the shank.

Figure 9:
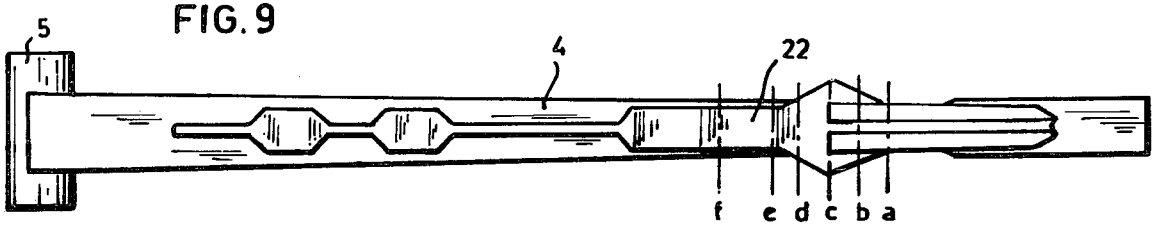
FIGS. 9 through 11 show a shank which is provided with a rack guide, in top and bottom view, respectively, and a number of sectional views at the locations indicated with a through f.
Figure 10:
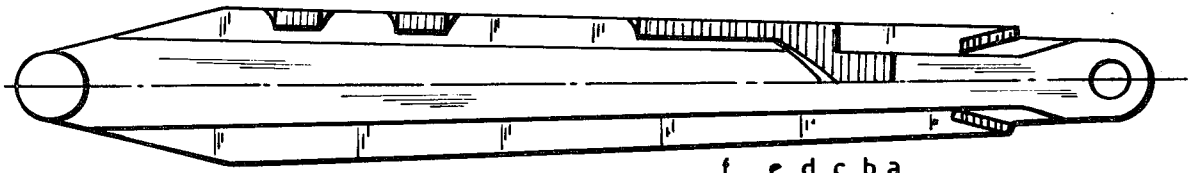
Figure 11:
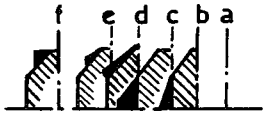

FIGS. 9–11 show a rack guide 22 to get the anchor into the rack in the right manner. It is indeed a fact that the sharp shank gives difficulties because when the anchor is pulled into the rack, due to the chamfer of the shank, the anchor will come in askew and the bolster or the rack will enter between the two flukes. A pyramid-shaped boss on the sides of the shank at the front as indicated in cross-section in FIG. 11 gives the possibility for the anchor to turn in the right direction, and to tip over the fluke to be neatly positioned under the rack.

What is claimed is:

1. An anchor comprising:

a two-handed fluke means including fluke surfaces and formed with a hinge box, said fluke surfaces being disposed substantially on a parallel plane, each fluke of said fluke means being formed with outwardly extending curved tips on which are mounted outwardly turned vertical flukes which terminate in diverging peaks;

a shank pivotally mounted to said fluke means proximate to the geometric center of said fluke surfaces within said hinge box; and an outwardly extending rear stabilizer mounted at an outer edge of each fluke.

2. An anchor according to claim 1, characterized by a pre-cutter (13) to facilitate the penetration of the shank (4).

3. An anchor according to one of the preceding claims, characterized by an opening (11) for an anchor shackle (12) in the rear end of the fluke (2).

4. An anchor according to claim 3, characterized in that the anchor schackle (12) and the hinge pin (5) are integrally cast on the shank (4).

5. An anchor according to one of the preceding claims, characterized by a rack guide (22) comprising a pyramid-shaped boss on the sides of the shank at the front, which turns the anchor in the right direction and tips over the fluke.

* * * * *